United States Patent [19]

Tanaka et al.

[11] Patent Number: 4,766,935

[45] Date of Patent: Aug. 30, 1988

[54] POSITIVE DOBBY

[75] Inventors: Tadashi Tanaka; Noboru Sekitani, both of Ohtsu, Japan

[73] Assignee: Murata Kikai Kabushiki Kaisha, Kyoto, Japan

[21] Appl. No.: 87,697

[22] Filed: Aug. 20, 1987

[30] Foreign Application Priority Data

Aug. 25, 1986 [JP] Japan ..... 61-199822

[51] Int. Cl.[4] ..... D03C 13/00

[52] U.S. Cl. ..... 139/55.1; 139/76; 139/74

[58] Field of Search ..... 139/55.1, 66 R, 71, 139/74, 76, 77, 79, 80

[56] References Cited

U.S. PATENT DOCUMENTS

| | | | |
|---|---|---|---|
| 2,152,982 | 4/1939 | Watson et al. | 139/80 |
| 2,687,148 | 8/1954 | Pfarrwaller | 139/79 |
| 3,095,909 | 7/1963 | Pfarrwaller | 139/75 |
| 4,458,727 | 7/1984 | Mettler | 139/66 R |

*Primary Examiner*—Henry S. Jaudon

*Attorney, Agent, or Firm*—Spensley Horn Jubas & Lubitz

[57] ABSTRACT

A positive dobby in which a pair of cam plates for moving each heald frame positively vertically are provided separately on the first cam shaft and on the second cam shaft parallel to the first cam shaft, whereby the dobby is constituted without enlarging the pitch between the cam plates corresponding to each heald frame.

7 Claims, 7 Drawing Sheets

POSITIVE DOBBY

FIELD OF THE INVENTION AND RELATED ART STATEMENT

The present invention relates to a positive dobby and particularly to a positive cam type dobby.

There has been known a positive dobby in which shedding motions, including both ascent and descent, of each heald frame are performed using positive cams without using any spring. According to such positive dobby, two cam plates are coaxially disposed side by side for moving a single heald frame, and cam levers move pivotally following the cam plates, the motion of which cam levers is transmitted to and moves the heald frame vertically through a jack lever and a drive transfer rod.

In the above apparatus, since a pair of cam plates for controlling a single heald frame are coaxially provided side by side, the pitch between heald frames is also set in conformity with the cam plate pitch, so that the inter-heald frame pitch becomes large and the difference in the maximum amount of shed between the foremost and the rearmost end heald frame among plural heald frames is enlarged, causing a dynamic problem or an obstacle to speed-up of the camming machine.

OBJECT AND SUMMARY OF THE INVENTION

It is an object of the present invention to provide a positive dobby by which high-speed rotation of a cam device is effected.

In the present invention, a pair of shed controlling cams provided for each heald frame are disposed separately on a pair of cam shafts disposed in parallel.

In the present invention, a pair of cam plates for moving each heald frame positively vertically are provided separately on the first cam shaft and on the second cam shaft parallel to the first cam shaft, whereby the dobby is constituted without enlarging the pitch between the cam plates corresponding to each heald frame. Consequently, the inter-heald frame pitch can be made smaller and it is possible to effect high-speed rotation.

DETAILED DESCRIPTION OF PREFERRED EMBODIMENTS

An embodiment of the present invention will be described hereinunder with reference to the drawings.

Figure 5:
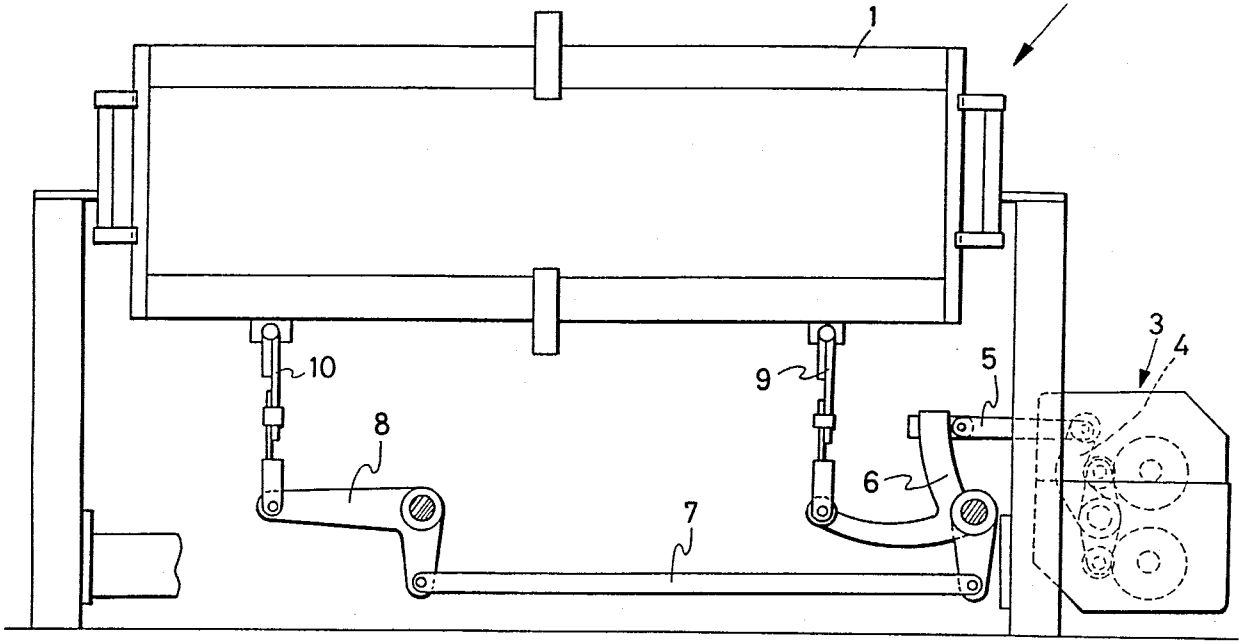
FIG. 5 is a front view showing an example of a weaving machine to which the apparatus of the present invention was applied.
Figure 6:
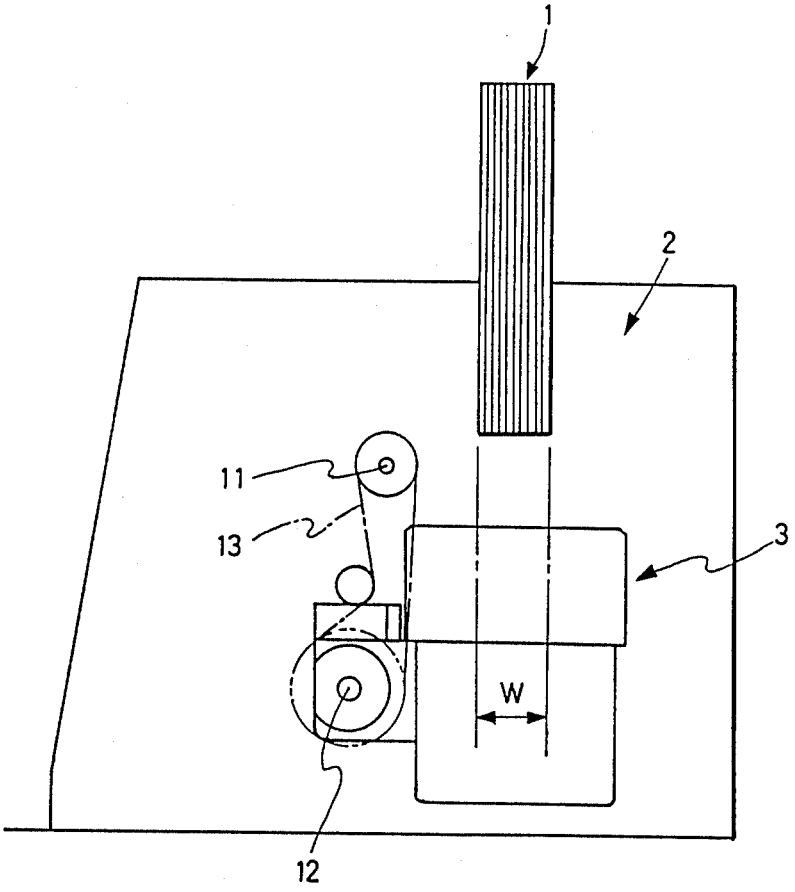
FIG. 6 is a side view thereof.

In FIGS. 5 and 6, a dobby 3 is mounted sideways of the lower portion of the base of a weaving machine 2 which has plural heald frames 1. The output of the dobby is transmitted to a rocking lever 6 through a jack lever 4 and a connecting lever 5 and further transmitted to another rocking lever 8 through a connecting rod 7, so that the heald frame 1 connected to the rocking levers 6 and 8 through connecting rods 9 and 10 moves vertically at a certain stroke to effect shedding of warp. In FIG. 6, a chain 13 is stretched between an output shaft 11 of the weaving machine and a driving shaft 12 of the dobby 3 to permit synchronized operation of the weaving machine and the dobby.

Figure 7:
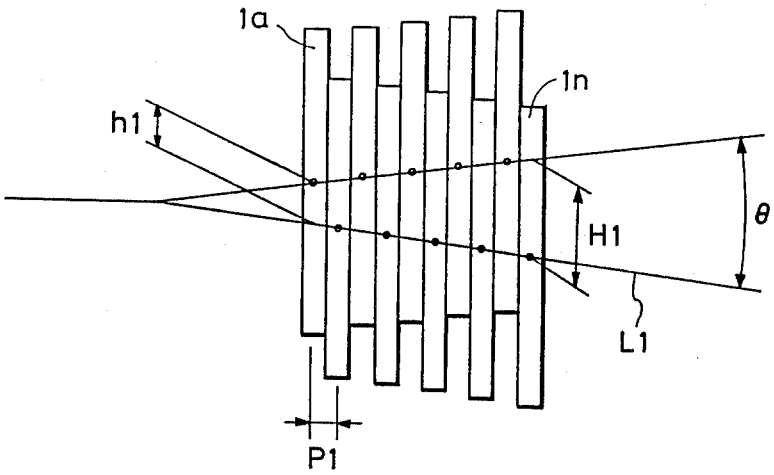
FIGS. 7 and 8 are explanatory views showing a difference in the maximum amount of shed caused by a difference in the heald frame pitch.
Figure 8:
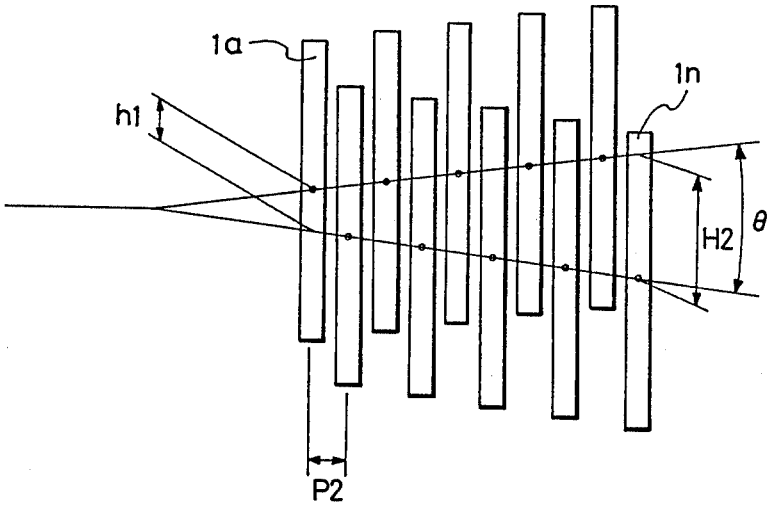

A plurality of such heald frames 1 are disposed side by side as indicated at 1*a* to 1*n*. It is desirable that the overall width (w) be as small as possible. More particularly, as in FIGS. 7 and 8 which illustrate sheds of the heald frames diagrammatically, the maximum amounts of shed H1 and H2 become larger with increase of inter-heald frame pitches P1 and P2 provided that there is no change in the number of heald frames. When $P1 < P2$, H1 H2, and thus momentum becomes larger. For speed-up, it is desirable that the pitches P1 and P2 be as small as possible.

The dobby of the present invention will be described below with reference to FIGS. 1 and 2.

The dobby 3 is composed of first and second parallel cam shafts 14 and 15, cam plates 16 and 17 mounted on the cam shafts 14 and 15 rotatably with respect to the cam shafts, cam levers 18 adapted to move pivotally about the driving shaft 12 following the paired cam plates 16 and 17, the jack lever 4 integrally combined with the cam levers 18, input gears 19 and 20 supported on the driving shaft 12, intermediate gears 25 and 26 pivotally secured at 23 and 24 to arms 21 and 22 which are supported on the shaft 12, first gears 27 and 28 supported rotatably on the first cam shaft 14, second gears 29 and 30 supported rotatably on the second cam shaft 15, and idle gears 31 and 32 disposed between the said first and second gears.

The second cam shaft 15 and shafts 33 and 34 of the idle gears 31 and 32 are provided on brackets 35 and 36 which are pivotable about the first cam shaft 14. In normal operation, the brackets 35 and 36 are fixed to a frame 38 with bolts 37 in their positions shown in FIG. 1. In a later-described levelling operation, the bracket 35 is pivotable at a certain angle in a counterclockwise direction about the first cam shaft 14.

Between the jack lever 4 and the rocking lever 6 is connected the lever 5 through an adjuster 39. The rocking motion of the jack lever 4 causes the rocking lever 6 to pivot about a shaft 40, so that the heald frame (indicated at 1 in FIG. 5) positively moves vertically.

Figure 2:
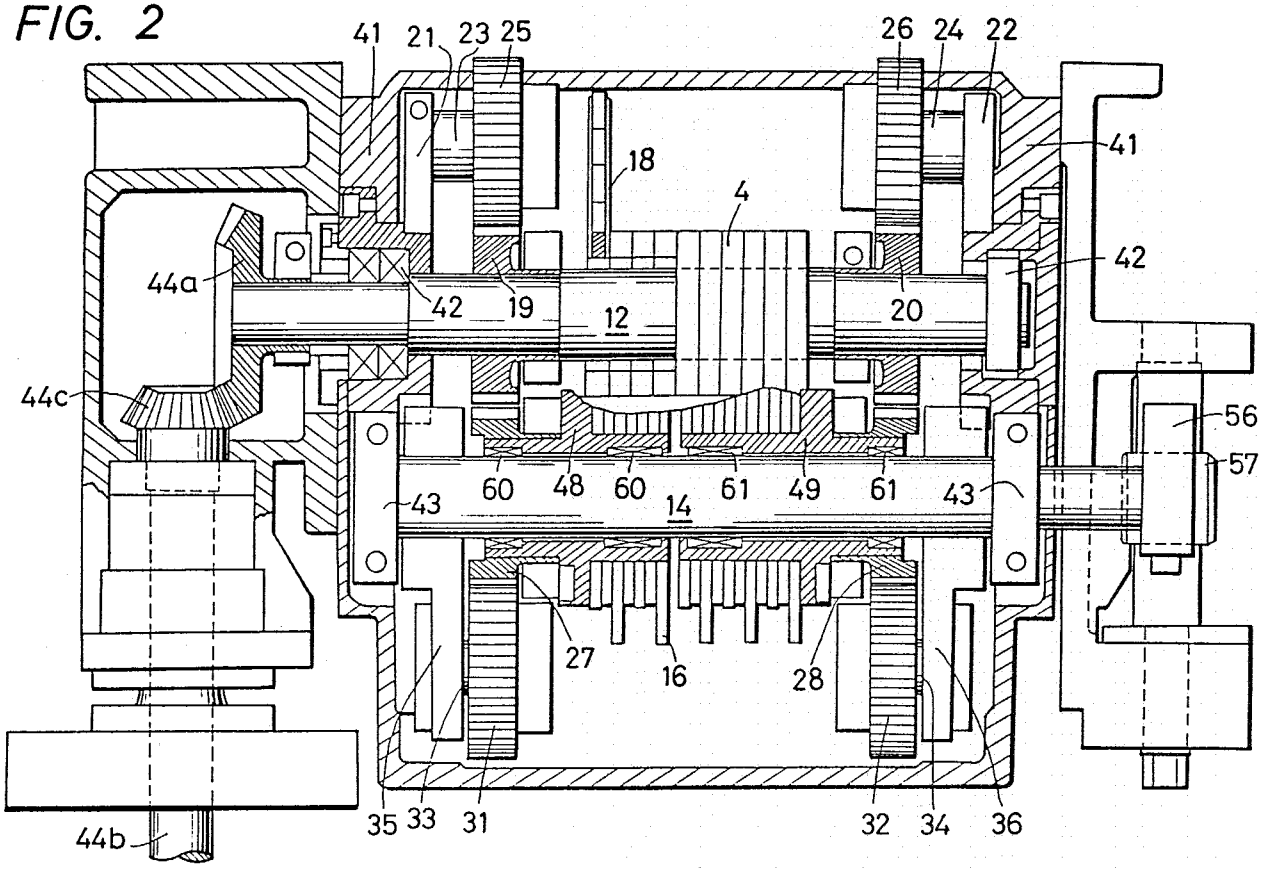
FIG. 2 is a sectional side view thereof, partly in development.

In FIG. 2, the driving shaft 12 and the first cam shaft 14 are supported axially in parallel by a body frame 41 rotatably through bearings 42 and 43. A bevel gear 44*a* is fixed to one end of the driving shaft 12, and a bevel gear 44*c* on an input shaft 44*b* which is rotated by the output provided from the weaving machine side, is in mesh with the gear 44*a*. Further, the cam levers 18 are fitted on an intermediate part of the driving shaft 12 loosely at a pitch equal to the heald frame pitch. At both end portions of the cam levers 18 are supported cam rollers 45 and 46 which follow the cam plates 16 and 17, and the jack lever 4 supported rotatably on the shaft 12 is combined with the cam levers 18 integrally through pins 47 to follow the motion of the cam levers 18.

On the other hand, although the first cam shaft 14 along is shown in FIG. 2, the cam plate 16 is fixed to cam holders 48 and 49 at an intermediate portion of the cam shaft 14 at a pitch equal to the heald frame pitch. The cam holders 48 and 49 are divided in two and are rotatable with respect to the shaft 14 through two pairs of bearings 60 and 61. One cam holder 48 is integral with the gear 27 and the other cam holder 49 integral with the gear 28. The rotating speeds of the holders 48 and 49 are changeable each independently. That is, the shedding speed at the weave front half of the heald frame and that at the rear half thereof can be changed according to weaves.

Figure 1:
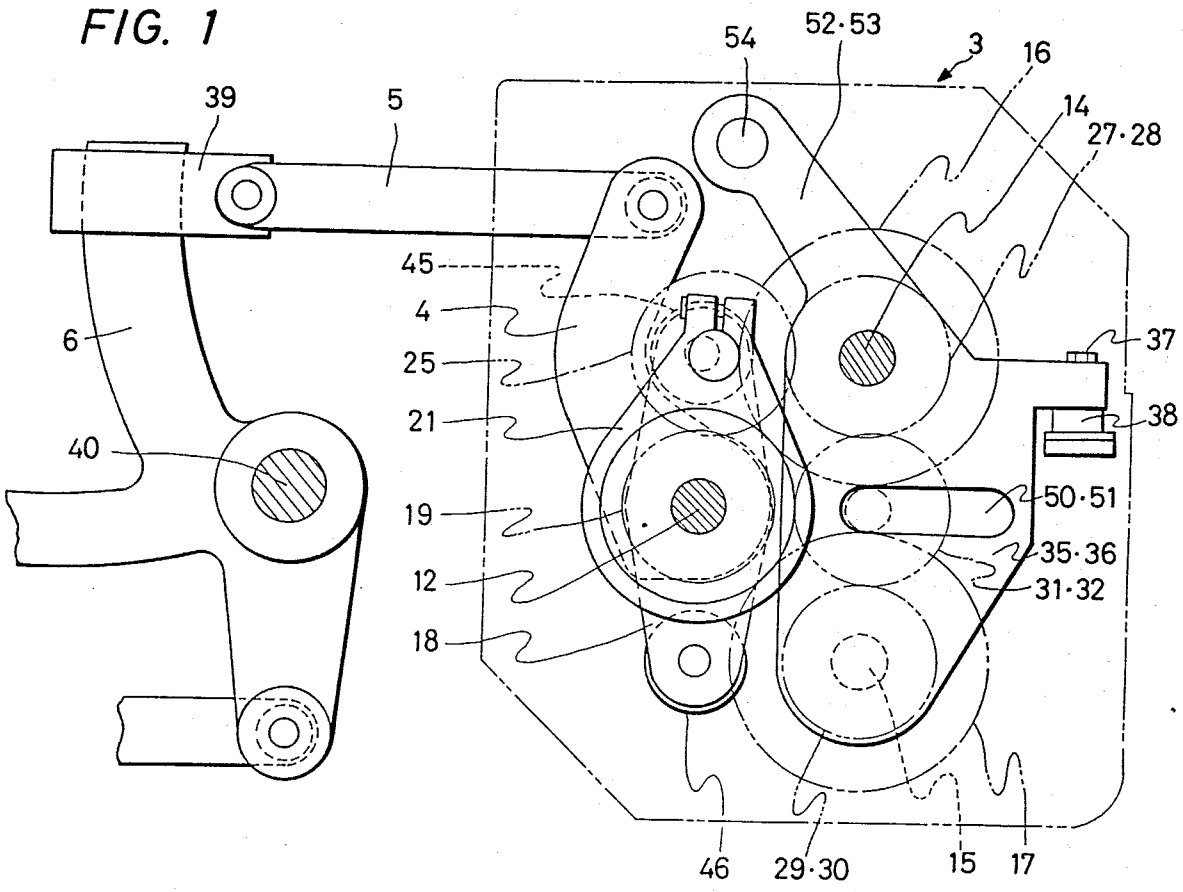
FIG. 1 is a schematic constructional front view showing an embodiment of the apparatus of the present invention.

Further, as shown in FIG. 1, the shafts 33 and 34 of the idle gears 31 and 32 are movable along slots 50 and 51 formed in the brackets 35 and 36 and they are positioned and fixed in appropriate positions in those slots according to the size of the gears 27, 28, 29 and 30. More specifically, the shape of the cam plates 16 and 17 is determined according to the textile weave, and their rotating speed is sometimes decelerated to, for example, one half or one third of that of the gears 19 and 20 on the driving shaft 20. In such a case, as the gears 27, 28, 29 and 30 on the cam shafts 14 and 15 there are used those of another diameter. Accordingly, the idle gears 31 and 32 are moved downwards of the slots 50 and 51 to an appropriate extent, then positioned and fixed there.

In FIG. 1, moreover, a rod 54 extends between arm portions 52 and 53 of the brackets 35 and 36 supported at both end portions of the shaft 14. As the brackets 35 and 36 turn counterclockwise about the shaft 14, the rod 54 comes into abutment with the jack levers 4, causing all the jack levers 4 to turn counterclockwise at a certain angle about the shaft 12. Further, in association with the movement of the cam shaft 15 the cam rollers 45 and 46 at both ends of all the cam levers 18 are moved to positions independent of the paired cam plates 16 and 17, and all the heald frames are positioned in their lowest positions suitable for performing the levelling operation.

The operation of the above dobby will be explained below with reference to FIG. 3.

Figure 3A:
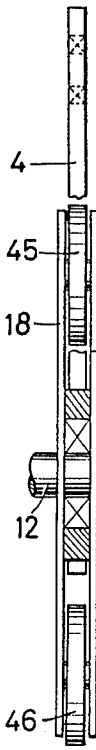
FIG. 3A is a side view of the cam levers, partly in section.
Figure 3:
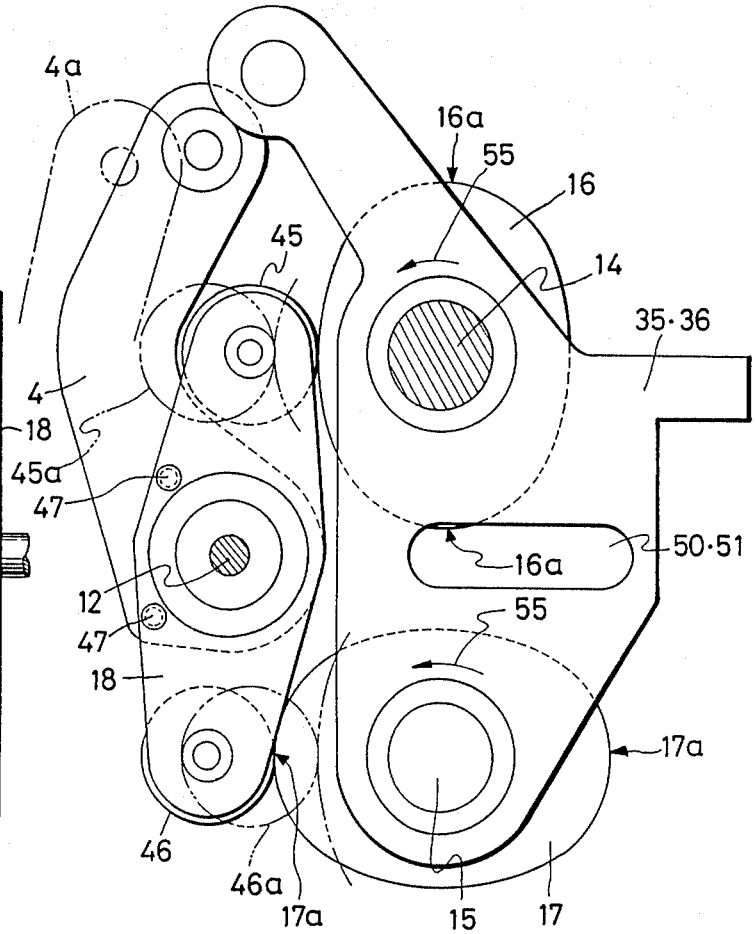
FIG. 3 is a front view showing the relation between cam plates and jack levers, cam levers.

For example, in making a plain weave, such cam plates 16 and 17 as shown in FIG. 3 are mounted on the first and second cam shafts 14 and 15 as a pair of cam plates for controlling a single heald frame. The cam plates 16 and 17 repeat high-low-high with a period of 90° and they are fixed in the relation of 90° out of phase with each other.

Consequently, the cam levers 18 pivot about the shaft 12 under the action of the cam plates 16 and 17 rotating synchronously in the direction of an arrow 55 as shown in FIG. 3, and the cam rollers 45 and 46 move between their solid line positions and double-dot chain line positions 45*a*, 46*a*, so that the jack lever 4 integral with the cam levers 18 also moves between its solid line position and double-dot chain line position 4*a*, thus causing the heald frame to perform a vertical motion. More specifically, when the heald frame is to be brought down, the jack lever 4 pivots up to its double-dot chain line 4*a* position under the action of a large diameter portion 16*a* of the cam plate 16, while when the heald frame is to be brought up, the jack lever 4 pibots from its double-dot chain line position 4*a* to its solid line position 4 under the action of a large diameter portion 17*a* of the cam plate 17 on the cam roller 46. Thus, the heald frame is moved in both up and down directions positively using cams.

The following description is now provided about the levelling mechanism of the above dobby.

Figure 4:
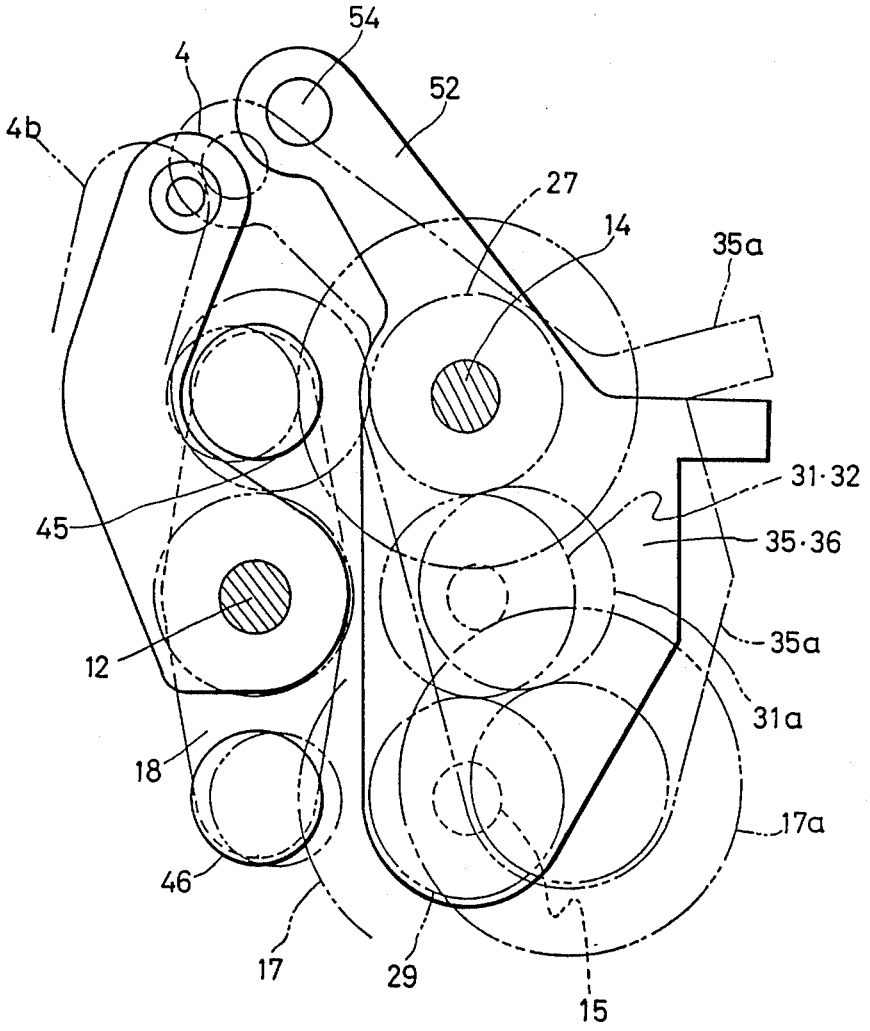
FIG. 4 is an explanatory front view showing a levelling operation.

In FIG. 4, when the bracket 35 is pivoted about the first cam shaft 14 up to its double-dot chain line position 35*a*, the second cam shaft 15 supported on the bracket 35 and the cam plate 17, as well as the idle gears 31 and 32, also turn around the first cam shaft 14. The pivoting motion of the bracket 35 can be effected, for example using a worm wheel 56 fixed to an end portion of the first cam shaft 14 and a worm shaft 57 meshing with the worm wheel 56. The worm shaft 57 can be rotated automatically or manually by means of a motor or a tool such as a wrench. It goes without saying that the bracket fixing bolt 37 shown in FIG. 1 is removed in the above levelling operation.

When the bracket 35 is pivoted as in FIG. 4, the rod 54 at the fore end of the arm 52 comes into abutment with an end portion of the jack lever 4. In this embodiment, adjacent jack levers 4 are in opposite upper and lower positions, respectively, so the rod 54 abuts the jack levers which are in the solid line positions corresponding to the raised heald frames, not abutting half the jack levers.

When the bracket 35 is further pivoted up to its double-dot chain line position 35*a*, the idle gears 31, 32 and the cam plate 17 on the cam shaft 15 also move up to their double-dot chain line positions. Consequently, the second cam plates 17*a* assume positions spaced from all the cam rollers 46. At this time, with the pivoting motion of the bracket 35 about the first cam shaft 14, the idle gear 31 meshing with the gear 27 which is in a stationary state, revolves along the gear 27 while rotating round its own axis. On the other hand, the cam plate 17, which is in a stationary state, leaves the cam roller 46 without rotation of the gear 29 on the second cam shaft 15, notwithstanding its engagement with the idle gear 31, so that the cam plate 17 leaves the cam roller 46 quietly without turning in abutment with the cam roller 46.

Consequently, the jack lever 4 which is pushed by the arm 52 turns counterclockwise about the shaft 12 as indicated at 4*b*, causing half the heald frames in the raised positions to move to their lowered positions, with the result that all the heald frames are positioned in their lowered positions. In this state, therefore, the warp line passing each heald frame 1 coincides with line L1 shown in FIG. 7 and no shed is formed. That is, in this state there are performed such operations as level setting for the heald frames and passing of warp.

Since in this embodiment the pivoting motion of the bracket in the levelling operation is done around the first cam shaft 14, the cam plate on the side of the second cam shaft 15, namely, on the heald frame pushingup side, is allowed to escape to its inoperative position, so that the heald frame levelling position can be set to the lowest position and the own weight of the heald frame can be utilized without exerting a large force on the jack lever, thus ensuring easy operation.

What is claimed is:

1. A positive dobby comprising:

a driving shaft;

a first cam shaft being supported axially in parallel to the driving shaft;

a second cam shaft being provided on brackets which are pivotable about the first cam shaft;

a pair of cam plates mounted on the first and second cam shafts rotatably with respect to the cam shafts;

cam levers adapted to move pivotally about the driving shaft following the paired cam plates; and jack levers integrally combined with the cam levers.

2. A positive dobby as claimed in claim 1, wherein said dobby further includes input gears supported on the driving shaft;

intermediate gears pivotally secured to arms which are supported on the driving shaft;

first gears supported rotatably on the first cam shaft;

second gears supported rotatably on the second cam shaft; and idle gears disposed between the first and second gears.

3. A positive dobby as claimed in claim 2, wherein shafts of said idle gears are movable along slots formed in the brackets and are fixed in appropriate position in those slots.

4. A positive dobby as claimed in claim 1, wherein cam rollers which follow said cam plates are supported at both end portions of each of the cam levers and the jack lever supported rotatably on the driving shaft is combined with the cam lever integrally through pins to follow the motion of the cam lever.

5. A positive dobby as claimed in claim 4, wherein the cam plates are fixed to cam holders at an intermediate portion of the first cam shaft at a pitch equal to the heald frame pitch, said cam holders being divided in two and are rotatable with respect to the first shaft so that the rotating speeds of the holders are changeable each independently.

6. A positive dobby as claimed in claim 5, wherein a rod extends between arm portions of the brackets whereby the rod comes into abutment with the jack levers to turn counterclockwise at a certain angle about the driving shaft when the brackets turn counterclockwise about the first cam shaft, so that the cam rollers at both ends of all the cam levers are moved to positions independent of the paired cam plates and all of the heald frames are positioned in their lowest positions suitable for performing the levelling operation.

7. A positive dobby as claimed in claim 6, wherein the pivoting motion of the brackets are effected using a worm wheels fixed to an end portion of the first cam shaft and worm shafts meshing with the worm wheels.

* * * * *